US011938369B2

(12) United States Patent
Li et al.

(10) Patent No.: US 11,938,369 B2
(45) Date of Patent: Mar. 26, 2024

(54) TREADMILL WITH ANTI-ENTRAPMENT FUNCTION

(71) Applicant: REXON INDUSTRIAL CORP., LTD., Taichung (TW)

(72) Inventors: Wen-Tu Li, Taichung (TW); Ssu-Shun Yang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 143 days.

(21) Appl. No.: 17/746,208

(22) Filed: May 17, 2022

(65) Prior Publication Data

US 2022/0362627 A1 Nov. 17, 2022

(51) Int. Cl.
*A63B 22/02* (2006.01)

(52) U.S. Cl.
CPC .... *A63B 22/0235* (2013.01); *A63B 2220/833* (2013.01)

(58) Field of Classification Search
CPC ..... A63B 22/0235; A63B 2220/833; A63B 2071/0081; A63B 2071/009; A63B 71/0054; A63B 22/025; A63B 21/4035; A63B 24/0087; A63B 2225/74; A63B 2230/208; A63B 2230/505; A63B 21/005; A63B 21/008; A63B 21/0085; A63B 22/0023; A63B 24/0059; A63B 2024/009; A63B 2071/0072; A63B 2071/0658; A63B 2071/0694; A63B 2220/53; A63B 2220/805; A63B 2225/09; A63B 2225/093; A63B 2225/685; A63B 2230/062; A63B 69/0057; A63B 2071/0625; A63B 2071/063; A63B 2071/0647; A63B 2071/0655; A63B 2220/13; A63B 2220/18; A63B 2220/30; A63B 2220/40; A63B 2220/803; A63B 2230/75; A63B 2071/0063; A63B 2220/56; A63B 2225/682; A63B 2230/06; A63B 22/0285; A63B 71/0622; A63B 2024/0093;

(Continued)

(56) References Cited

U.S. PATENT DOCUMENTS 4,227,487 A * 10/1980 Davis ..... A01K 15/027 119/700
5,314,391 A * 5/1994 Potash ..... A63B 22/0023 73/379.06

(Continued)

*Primary Examiner* — Garrett K Atkinson
(74) *Attorney, Agent, or Firm* — BACON & THOMAS, PLLC

(57) ABSTRACT

A treadmill with an anti-entrapment function allows a user to stand on the treadmill and includes a running unit, a control unit, and a sensing unit. The running unit includes two lateral bases, a driving roller, a driven roller, and a running belt. Each lateral base has a bottom end portion. The sensing unit includes a guard bar pivotally provided at the bottom end portions and at least one sensing member. When the user is accidentally pulled into the gap between the running belt and one of the lateral bases, the guard bar will be subjected to an external force and thus rotated downward about a rotation axis, thereby driving the at least one sensing member to send a warning signal to the control unit, in order for the control unit to control the rotation speed of the driving roller accordingly, lest the user be pulled deeper into the gap.

6 Claims, 5 Drawing Sheets

(58) Field of Classification Search
CPC ..... A63B 2071/0691; A63B 2220/22; A63B 2225/50; A63B 2230/04; A63B 2230/207; A63B 2230/42; A63B 2230/50; A63B 2230/00; A63B 2220/62; A63B 2220/806; A63B 2220/807; A63B 2225/72
See application file for complete search history.

(56) References Cited

U.S. PATENT DOCUMENTS 5,368,532 A * 11/1994 Farnet ..... A63B 22/02 482/54
6,387,015 B1 * 5/2002 Watson ..... A63B 23/047 482/54
6,454,679 B1 * 9/2002 Radow ..... A63B 22/0235 482/4
6,572,512 B2 * 6/2003 Anderson ..... A63B 22/0207 482/54
6,733,423 B1 * 5/2004 Chang ..... A63B 22/02 482/54
7,344,481 B2 * 3/2008 Watterson ..... A63B 22/02 482/4
7,713,172 B2 * 5/2010 Watterson ..... A63B 71/0622 482/4
7,780,573 B1 * 8/2010 Carmein ..... A63B 71/0622 482/4
8,444,533 B2 * 5/2013 Robinson ..... A63B 21/0087 482/54
8,480,541 B1 * 7/2013 Brunts ..... A63B 22/025 482/7
9,328,866 B2 * 5/2016 Kuo ..... F16N 13/22
9,642,521 B2 * 5/2017 Ye ..... A61B 3/14
9,870,622 B1 * 1/2018 Lu ..... G16H 50/50
10,661,119 B2 * 5/2020 Bradley ..... A61B 5/1117
2006/0291694 A1 * 12/2006 Venetianer ..... G06V 40/103 382/103
2007/0004562 A1 * 1/2007 Pan ..... A63B 24/00 482/54
2009/0036272 A1 * 2/2009 Yoo ..... A63B 22/0257 482/7
2010/0093492 A1 * 4/2010 Watterson ..... A63B 22/0242 482/4
2011/0144542 A1 * 6/2011 Jin ..... G08B 21/0446 600/595
2015/0146169 A1 * 5/2015 Ye ..... A61B 3/0083 351/204
2016/0263429 A1 * 9/2016 Wagner ..... A63B 22/18
2016/0339294 A1 * 11/2016 Blach ..... A63B 21/04
2017/0065849 A1 * 3/2017 Konishi ..... A61B 5/1038
2018/0243611 A1 * 8/2018 Bradley ..... A63B 71/0054

* cited by examiner

TREADMILL WITH ANTI-ENTRAPMENT FUNCTION

BACKGROUND OF THE INVENTION

1. Technical Field

The present invention relates to physical training equipment, and more particularly to a treadmill with an anti-entrapment function.

2. Description of Related Art

People nowadays pay more and more attention to health. It is therefore not uncommon to have a treadmill placed in one's house so that physical training can be carried out at home, rain or shine, with the treadmill.

Generally, a treadmill has a setting panel, or control panel, with which a user can adjust the rotation speed of the running belt according to the desired running speed.

While the user can adjust the rotation speed of the running belt with the control panel if the rotation speed is too high, the relatively small sizes of the buttons on the control panel make it difficult to find any button rapidly when the user is nervous or in an urgent situation. Moreover, should the user fall, it will be difficult for the user to press any button on the control panel, which is usually at a relatively great height, and the running belt will therefore keep rotating and may pull and entrap the user's clothes, limbs or foreign objects into a gap on either side of, or under, the running belt, which is dangerous.

BRIEF SUMMARY OF THE INVENTION

One objective of the present invention is to provide a treadmill that has an anti-entrapment function to prevent the entrapment of the user's clothes, limbs or foreign objects.

The treadmill of the present invention has an anti-entrapment function and allows a user to stand on the treadmill. The treadmill with the anti-entrapment function includes a running unit, a driving unit, a control unit, and a sensing unit.

The running unit includes a main base, two lateral bases that extend rearward from the main base and are spaced apart from each other, a driving roller and a driven roller that are pivotally provided between the lateral bases, and a running belt that is provided between the lateral bases, is looped around the driving roller and the driven roller, and allows the user to stand on the running belt. The direction in which each lateral base extends is defined as a direction along or substantially parallel to a front-rear axial direction of the running unit. Each lateral base has a front section adjacent to the main base and a rear section extending away from the front section along the front-rear axial direction. Each rear section has a top end portion higher than the running belt and a bottom end portion lower than the running belt.

The driving unit is provided at the main base and is configured to drive the driving roller into rotation so that the running belt is driven to rotate around the driving roller and the driven roller, thereby allowing the user to run forward on the running belt along the front-rear axial direction.

The control unit is in signal communication with the driving unit.

The sensing unit includes a guard bar and at least one sensing member. The guard bar is pivotally provided at the bottom end portions of the running unit and is at least partially located at the back of the running belt. The at least one sensing member is provided at the running unit. The guard bar is configured to rotate about a rotation axis that is perpendicular to the front-rear axial direction. When the guard bar is subjected to an external force and is thus rotated downward about the rotation axis, the at least one sensing member is driven by the guard bar to send a warning signal to the control unit, in order for the control unit to control the rotation speed of the driving roller accordingly.

The present invention has the following effects: When the user's clothes, limbs or foreign objects are accidentally pulled into the gap between the running belt and one of the lateral bases, the guard bar will be driven to rotate about the rotation axis, causing the at least one sensing member to send out the warning signal. The control unit will receive the warning signal immediately and then control the rotation speed of the driving roller in order to keep the user's clothes, limbs or foreign objects are from being pulled deeper into the gap.

BRIEF DESCRIPTION OF THE SEVERAL VIEWS OF THE DRAWINGS

Other features and effects of the present invention can be known by referring to the following detailed description in conjunction with the accompanying drawings, in which.

DETAILED DESCRIPTION OF THE INVENTION

Figure 1:
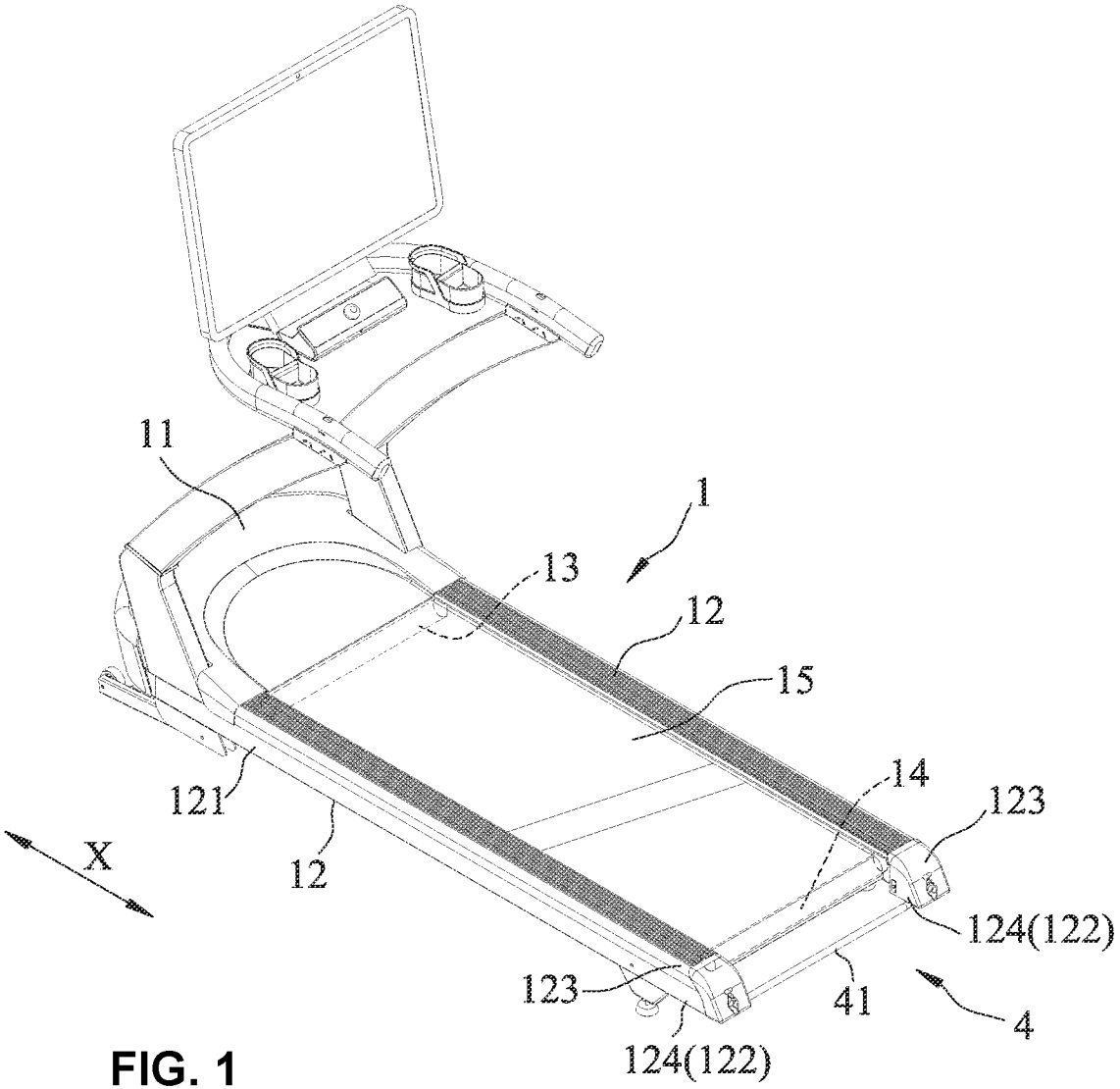
FIG. 1 is a perspective view of the treadmill with an anti-entrapment function according to an embodiment of the invention.
Figure 2:
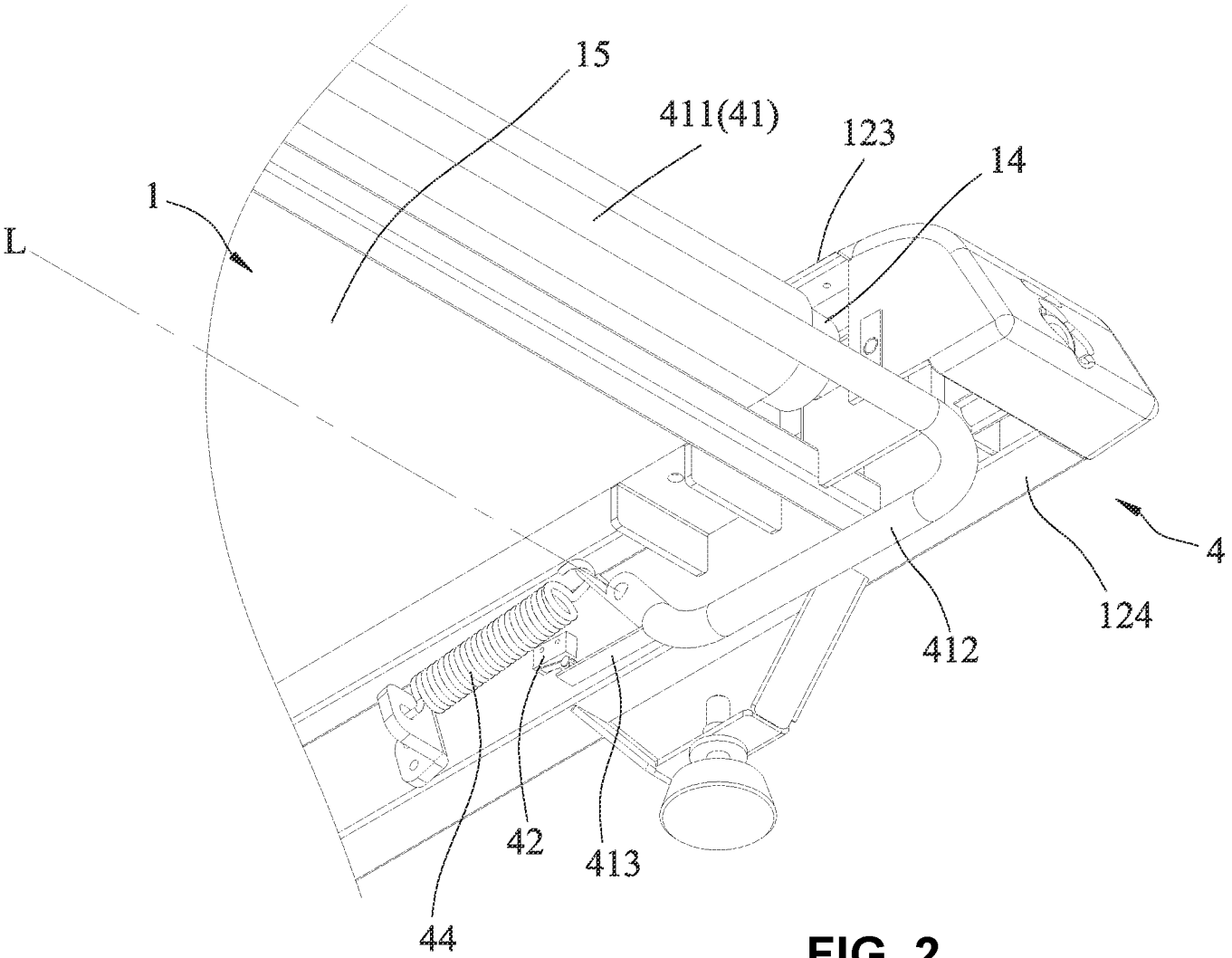
FIG. 2 is a partial perspective view of the treadmill in FIG. 1 and is taken from a different viewing angle from that of FIG. 1.
Figure 3:
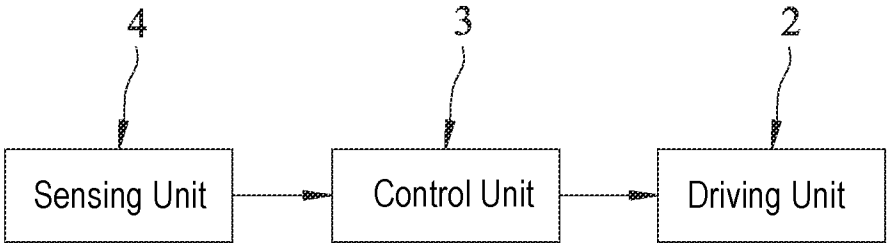
FIG. 3 is a system block diagram of the treadmill in FIG. 1.

Referring to FIG. 1 to FIG. 3, the treadmill with an anti-entrapment function according to an embodiment of the prevent invention allows a user (not shown) to stand on the treadmill, and includes a running unit 1, a driving unit 2, a control unit 3, and a sensing unit 4.

The running unit 1 includes a main base 11, two lateral bases 12 that extend rearward from the main base 11 and are spaced apart from each other, a driving roller 13 and a driven roller 14 that are pivotally provided between the lateral bases 12. A running belt 15 is provided between the lateral bases 12, and is looped around the driving roller 13 and the driven roller 14 to allow the user to stand on the running belt 15. The direction in which each lateral base 12 extends is defined as a front-rear axial direction X of the running unit 1.

Each lateral base 12 has a front section 121 adjacent to the main base 11 and a rear section 122 that extends away from the front section 121 along the front-rear axial direction X. Each rear section 122 has a top end portion 123 higher than the running belt 15 and a bottom end portion 124 lower than the running belt 15.

The driving unit 2 is provided at the main base 11 and is configured to drive the driving roller 13 into rotation, thereby driving the running belt 15 to rotate around the driving roller 13 and the driven roller 14 so that the user can run forward on the running belt 15 in the front-rear axial direction X. In this embodiment, the driving roller 13 is located at the front side, and the driven roller 14 at the rear side; the present invention, however, has no limitation on which of the two rollers is at the front or rear side.

The sensing unit 4 includes a guard bar 41, at least one sensing member 42, and at least one elastic member 43. The guard bar 41 is pivotally provided at the bottom end portions 124 and is at least partially located at the back of the running belt 15. The at least one sensing member 42 is provided at the running unit 1. The at least one elastic member 43 is connected to the guard bar 41.

In this embodiment, the sensing unit 4 includes two sensing members 42 and two elastic members 43. (FIG. 2 shows only the sensing member 42 and elastic member 43 provided at one of the lateral bases 12. The other sensing member 42 and the other elastic member 43 are provided at the other lateral base 12 in a symmetric manner.) The sensing members 42 are provided at the bottom end portions 124 respectively, and each sensing member 42 is a microswitch. The control unit 3 is in signal communication with the driving unit 2 and the sensing members 42.

As shown in FIG. 1, FIG. 3, FIG. 4, and FIG. 5, the guard bar 41 has a transverse bar section 411, two pivotal connection sections 412, and two sensing sections 413. The transverse bar section 411 corresponds to the space between the bottom end portions 124 and is located at the back of the running belt 15. The pivotal connection sections 412 extend forward from the two opposite ends of the transverse bar section 411 respectively and are pivotally connected to the bottom end portions 124 respectively. Each sensing section 413 is connected between the corresponding pivotal connection section 412 and the corresponding sensing member 42.

The guard bar 41 is configured to rotate about a rotation axis L that is perpendicular to the front-rear axial direction X. When the guard bar 41 is subjected to an external force and is thus rotated downward about the rotation axis L (see FIG. 5), the sensing members 42 are driven by the guard bar 41 to send a warning signal to the control unit 3, in order for the control unit 3 to control the rotation speed of the driving roller 13 accordingly. Each elastic member 43 is connected between the corresponding pivotal connection section 412 and the corresponding lateral base 12 and is configured to provide the guard bar 41 with a bias that always tends to rotate the guard bar 41 upward. In this embodiment, each elastic member 43 is a tension spring. The present invention, however, has no limitation on the configuration of the elastic members 43.

To use the treadmill with the anti-entrapment function, the user stands on the running belt 15 and then starts running forward. Should the user's clothes, limbs or a foreign object (not shown) be accidentally pulled into the gap between the running belt 15 and one of the lateral bases 12, the rotating running belt 15 will move the user's clothes, limbs or foreign object to the rear side of the running belt 15 and then pull the user's clothes, limbs or foreign object downward.

As the transverse bar section 411 of the guard bar 41 corresponds to the space between the bottom end portions 124 and is located at the back of the running belt 15, the user's clothing or limbs, or the foreign object, will press down on the transverse bar section 411 when pulled downward by the running belt 15. In consequence, the guard bar 41 is rotated downward about the rotation axis L and thereby drives the sensing members 42. More specifically, while the guard bar 41 is rotated downward about the rotation axis L, the end of each sensing section 413 that faces away from the corresponding pivotal connection section 412 is moved upward from the position shown in FIG. 4 to the position shown in FIG. 5 and thus triggers the corresponding sensing member 42.

Once triggered, the sensing members 42 send the warning signal to the control unit 3.

When receiving the warning signal, the control unit 3 controls the rotation speed of the driving roller 13 according to instructions written into the control unit 3 in advance. For example, the control unit 3 may control the driving roller 13 by immediately stopping the driving roller 13 from rotating or by gradually reducing the rotation speed of the driving roller 13 until the driving roller 13 stops rotating.

Thus, when the user's clothing or limbs, or the foreign object, is accidentally pulled into the gap between the running belt 15 and one of the lateral bases 12, the guard bar 41 will be driven to rotate about the rotation axis L and thereby cause the sensing members 42 to send out the warning signal. The control unit 3 will receive the warning signal at once and control the driving roller 13 by stopping it from rotating, lest the user or the foreign object be pulled deeper into the gap, the objective being to lower the severity of personal injury or of the damage of the foreign object or the treadmill with the anti-entrapment function.

Figure 4:
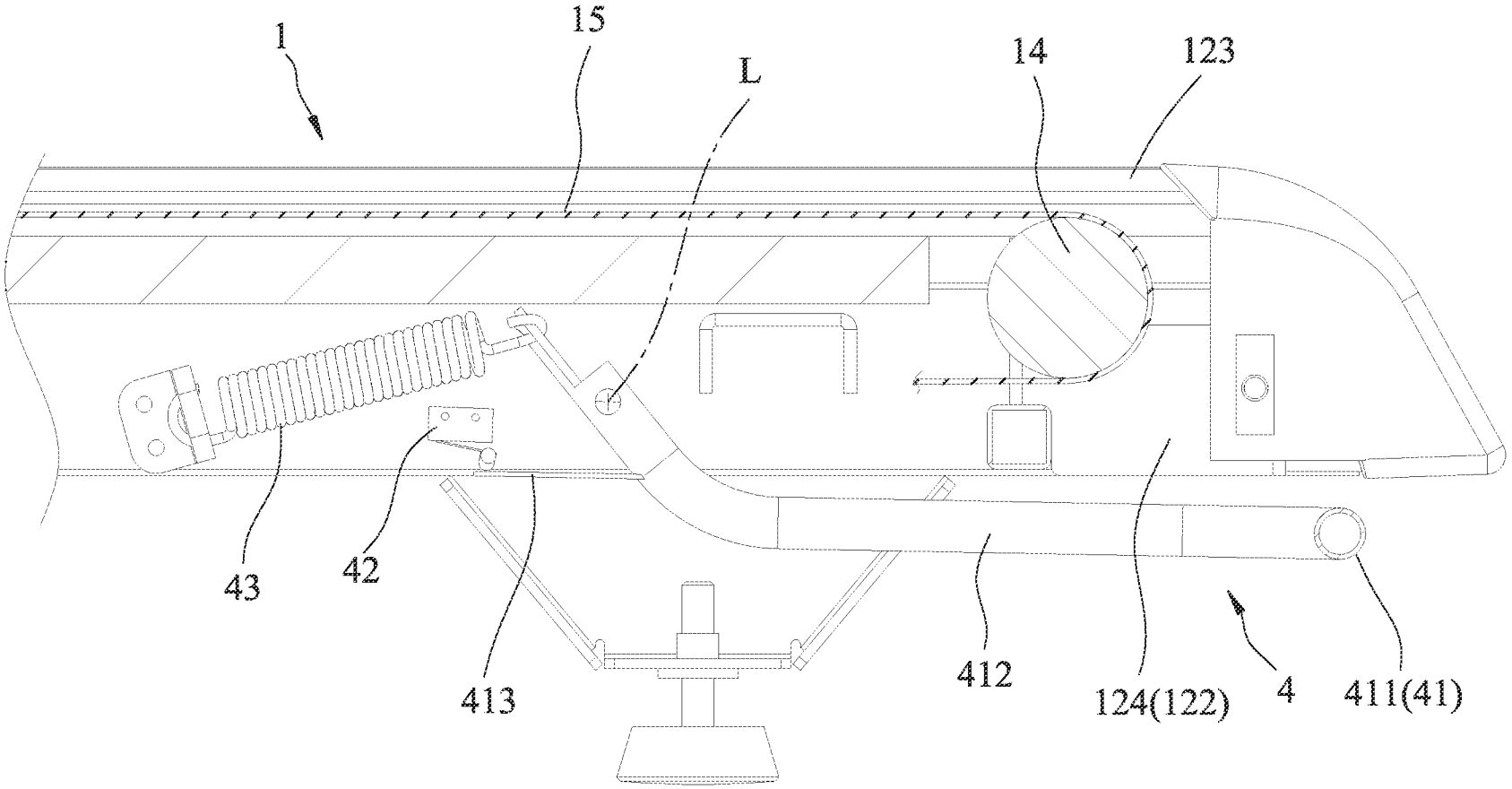
FIG. 4 is a partial sectional view of the treadmill in FIG. 1.
Figure 5:
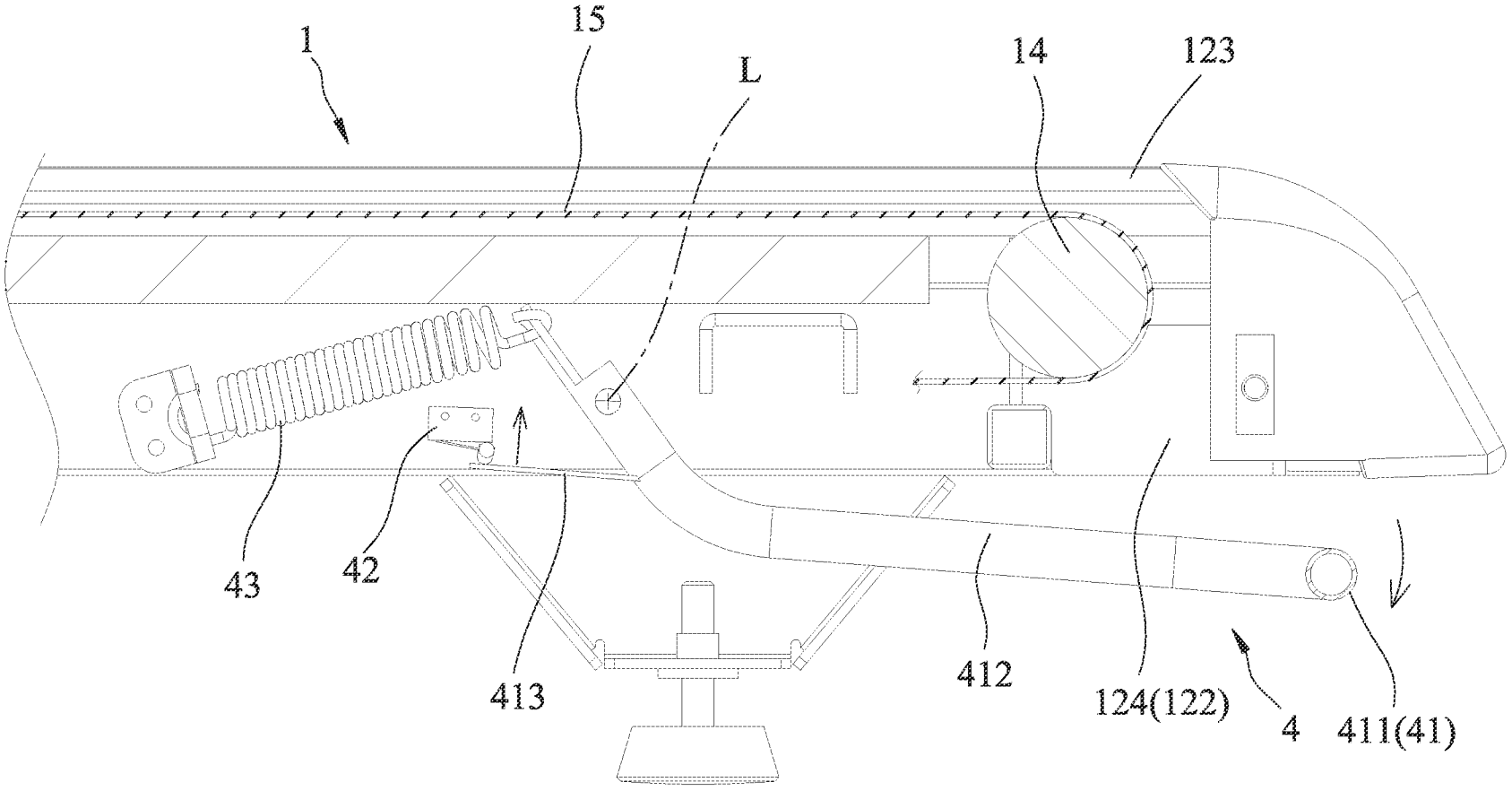
FIG. 5 is similar to FIG. 4 except that the guard bar of the treadmill is subjected to an external force and is thus rotated downward to drive a sensing member.

Once the condition of the user's clothing or limbs, or the foreign object, caught in the gap between the running belt 15 and one of the lateral bases 12 is cleared from the gap, the elastic members 43, which provide the guard bar 41 with potential energy that always tends to rotate the guard bar 41 upward, bring the guard bar 41 back to the position shown in FIG. 4. As a result, the sensing members 42 stop sending out the warning signal, and the driving roller 13 can once again be operated, i.e., rotated, to allow the user to continue running.

It is worth mentioning that, as the transverse bar section 411 of the guard bar 41 corresponds to the space between the bottom end portions 124 and is located at the back of the running belt 15, a person other than the user or a foreign object that is moving toward the treadmill with the anti-entrapment function from the back of the treadmill will be kept by the transverse bar section 411 from contact with the running belt 15. This prevents the person or the foreign object approaching the treadmill from the rear from being pulled into the gap under the running belt 15, thereby protecting the person from injury, or the foreign object and the treadmill with the anti-entrapment function from damage.

Moreover, it should be pointed out that while the guard bar 41 in this embodiment is pivotally provided at the bottom end portions 124 and, when subjected to an external force and thus rotated downward about the rotation axis L, can trigger the sensing members 42 by moving upward the end of each sensing section 413 that faces away from the corresponding pivotal connection section 412, it is not required that the guard bar 41 have the configuration described above. In other embodiments, the guard bar 41 may be movably provided at the bottom end portions 124, with one side of the guard bar 41 located at the back of the running belt 15, and the opposite side of the guard bar 41 extending forward, provided at the bottom end portions 124, and adjacent to the sensing members 42 so that when the guard bar 41 is moved (e.g., forward or downward) with respect to the bottom end portions 124 by an external force, each end of the guard bar 41 that is adjacent to one of the sensing members 42 will approach the corresponding sensing member 42 and drive the corresponding sensing member 42 to send out the warning signal. This alternative configuration is equally capable of achieving the objective stated above.

According to the foregoing, the treadmill with the anti-entrapment function as disclosed herein is so designed that when a user's clothing or limbs, or a foreign object, is accidentally pulled into the gap between the running belt 15 and one of the lateral bases 12, the guard bar 41 will be driven to rotate about the rotation axis L, in order for the sensing members 42 to send out the warning signal. The control unit 3 will receive the warning signal at once and control the driving roller 13 by stopping it from rotating, preventing the user's limb, clothing or the foreign object from being pulled deeper into the gap. Thus, the severity of personal injury or of the damage of the foreign object and the treadmill with the anti-entrapment function can be lowered to attain the objective of the invention.

It should be understood that the embodiments described above are only some feasible ones of the present invention and are not intended to be restrictive of the scope of the invention. Any equivalent change or modification that is based on the appended claims and the contents of this specification shall fall within the scope of the invention.

What is claimed is:

1. A treadmill with an anti-entrapment function, allowing a user to stand thereon, the treadmill with the anti-entrapment function comprising:

a running unit including a main base, two lateral bases, a driving roller, a driven roller, and a running belt, wherein the lateral bases extend rearward from the main base and are spaced apart from each other, the driving roller and the driven roller are pivotally provided between the lateral bases, the running belt is provided between the lateral bases, is looped around the driving roller and the driven roller, and allows the user to stand on the running belt, each said lateral base extends in a direction defined as a front-rear axial direction, each said lateral base has a front section adjacent to the main base and a rear section extending away from the front section along the front-rear axial direction, and each said rear section has a top end portion higher than the running belt and a bottom end portion lower than the running belt;

a driving unit provided at the main base and configured to drive the driving roller into rotation and consequently the running belt into rotation around the driving roller and the driven roller, thereby allowing the user to run forward on the running belt in the front-rear axial direction;

a control unit in signal communication with the driving unit; and a sensing unit including a guard bar and at least one sensing member, wherein the guard bar is movably provided at bottom end portions of the running unit and is at least partially located at a back end of the running belt, the at least one sensing member is provided at the running unit, the guard bar has a side located at the back of the running belt and an opposite side extending forward, provided at the bottom end portions, and adjacent to the at least one sensing member, such that when the guard bar is subjected to an external force and is thus moved with respect to the bottom end portions, an end of the guard bar that is adjacent to the at least one sensing member drives the at least one sensing member to send a warning signal to the control unit, in order for the control unit to control a rotation speed of the driving roller accordingly.

2. The treadmill with the anti-entrapment function as claimed in claim 1, wherein the guard bar in the sensing unit is pivotally provided at the bottom end portions, the guard bar is configured to rotate about a rotation axis perpendicular to the front-rear axial direction, and when subjected to the external force, the guard bar is rotated downward about the rotation axis and thereby drives the at least one sensing member to send the warning signal to the control unit.

3. The treadmill with the anti-entrapment function as claimed in claim 2, wherein the sensing unit includes two said sensing members, the sensing members are provided at the bottom end portions respectively, and the guard bar has a transverse bar section corresponding to a space between the bottom end portions and located at the back of the running belt, two pivotal connection sections extending forward from two opposite ends of the transverse bar section respectively and pivotally connected to the bottom end portions respectively, and two sensing sections each connected between a corresponding one of the pivotal connection sections and a corresponding one of the sensing members.

4. The treadmill with the anti-entrapment function as claimed in claim 3, wherein the sensing unit further includes two elastic members, and the elastic members are each connected between a corresponding one of the pivotal connection sections and a corresponding one of the lateral bases and are configured to provide the guard bar with potential energy always tending to rotate the guard bar upward.

5. The treadmill with the anti-entrapment function as claimed in claim 1, wherein upon receiving the warning signal, the control unit controls the driving roller by stopping the driving roller from rotating.

6. The treadmill with the anti-entrapment function as claimed in claim 1, wherein upon receiving the warning signal, the control unit controls the driving roller by gradually reducing the rotation speed of the driving roller until the driving roller stops rotating.

* * * * *